US011758321B2

(12) United States Patent
Ren et al.

(10) Patent No.: US 11,758,321 B2
(45) Date of Patent: Sep. 12, 2023

(54) SPEAKER BOX

(71) Applicant: AAC Microtech (Changzhou) Co., Ltd., Changzhou (CN)

(72) Inventors: Zhang Ren, Shenzhen (CN); Zhiwei Zhong, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 119 days.

(21) Appl. No.: 17/563,035

(22) Filed: Dec. 27, 2021

(65) Prior Publication Data

US 2022/0345810 A1 Oct. 27, 2022

(30) Foreign Application Priority Data

Apr. 26, 2021 (CN) ..... 202120880628.0

(51) Int. Cl.
*H04R 1/28* (2006.01)
*H04R 1/34* (2006.01)
*H04R 1/02* (2006.01)

(52) U.S. Cl.
CPC ..... *H04R 1/345* (2013.01); *H04R 1/021* (2013.01); *H04R 1/2803* (2013.01); *H04R 2499/11* (2013.01)

(58) Field of Classification Search
CPC .. H04R 1/2803; H04R 1/2849; H04R 1/2857; H04R 1/2888; H04R 1/2896; H04R 1/30; H04R 2400/11
See application file for complete search history.

(56) References Cited

U.S. PATENT DOCUMENTS 6,490,361 B1 * 12/2002 Klein ..... H04M 1/03 381/345
7,578,367 B2 * 8/2009 Yang ..... H04R 1/2811 379/433.02
10,178,467 B2 * 1/2019 Hou ..... H04R 1/2803
10,264,335 B1 * 4/2019 Ren ..... H04R 1/02
10,299,030 B2 * 5/2019 Zhong ..... H04R 9/06
10,341,780 B2 * 7/2019 Wang ..... H04R 31/003
10,462,559 B2 * 10/2019 Zhang ..... H04R 1/2888
(Continued)

FOREIGN PATENT DOCUMENTS

CN 108551635 A * 9/2018 ..... H04R 1/021
WO WO-2020209574 A1 * 10/2020 ..... H04M 1/0266

*Primary Examiner* — Ryan Robinson
(74) *Attorney, Agent, or Firm* — W&G Law Group

(57) ABSTRACT

Provided is a speaker box, including housing and sounding unit having diaphragm including vibration portion and suspension portion. The housing includes holder, lower and upper covers. The holder includes holder body, holder extension portion and holder fixing portion. The sounding unit is fixed to the holder fixing portion. Orthographic projection of the vibration portion completely falls into the holder body. The suspension portion is arc-shaped formed by recessing away from the holder body. The lower cover includes lower cover plate and lower cover sidewall. The sounding unit, the holder and the lower cover sidewall define front sound cavity. The sounding unit and the lower cover define rear sound cavity. The lower cover sidewall, the holder fixing portion, the holder extension portion and the upper cover define auxiliary rear sound cavity communicated with the rear sound cavity. The speaker box has large cavity volume and good acoustic performance.

10 Claims, 4 Drawing Sheets

(56) References Cited

U.S. PATENT DOCUMENTS

| | | | | |
|---|---|---|---|---|
| 10,469,953 | B2 * | 11/2019 | Qin | H04R 1/288 |
| 10,484,766 | B2 * | 11/2019 | Huo | H04R 1/2811 |
| 10,820,073 | B2 * | 10/2020 | Shan | H04R 1/20 |
| 11,265,645 | B2 * | 3/2022 | Pavlov | H04R 1/2849 |
| 11,317,195 | B2 * | 4/2022 | Ma | H04R 1/2803 |

* cited by examiner

SPEAKER BOX

TECHNICAL FIELD

The present disclosure relates to the field of electroacoustic conversion technologies, and in particular, to a speaker box.

BACKGROUND

Speaker boxes are widely used in portable mobile electronic products, such as mobile phones, to convert audio signals into sound for audio playing. The speaker boxes are featured with high loudness, low frequency and good sound effect.

In the related art, the speaker box includes an upper cover, a lower cover covering the upper cover and defining a receiving space together with the upper cover, and a sounding unit received in the receiving space. The upper cover includes an upper cover plate and a support wall extending from the upper cover plate to the sounding unit. The sounding unit is supported by and fixed to the support wall. The sounding unit includes a diaphragm configured to vibrate and sound. The diaphragm further includes a vibration portion, a suspension portion bending and extending from a periphery of the vibration portion to a direction away from the vibration portion, and a fixing portion bending and extending from the suspension portion to a direction away from the vibration portion. The sounding unit divides the receiving space into a front sound cavity and a rear sound cavity. The diaphragm is received in the front sound cavity.

However, in the speaker box in the related art, in order to ensure sealing performance and structural strength of fixation between the support wall and the sounding unit, the support wall is required to have a certain width. On the other hand, the suspension portion is generally designed as a positive suspension, so that the diaphragm does not occupy space in an inner cavity of the sounding unit. That is, the suspension portion is of an arc-shaped structure formed by protruding in a direction close to the upper cover. This enables a position of the upper cover directly opposite the suspension portion to be profiled to improve the acoustic performance. The above two factors make the upper cover require larger volume, so that the front sound cavity and the rear sound cavity are occupied by the volume of the upper cover and thus have small cavity volumes, thereby adversely affecting the acoustic performance of the speaker box.

Therefore, there is a need to provide a new speaker box to solve the above technical problems.

SUMMARY

An objective of the present disclosure is to provide a speaker box having a large cavity volume and good acoustic performance.

In order to achieve the above objective, the present disclosure provides a speaker box, including a housing having a receiving space and a sounding unit received in the receiving space. The sounding unit includes a diaphragm configured to vibrate and sound. The diaphragm including a vibration portion, a suspension portion bending and extending from a periphery of the vibration portion to a direction away from the vibration portion, and a diaphragm fixing portion bending and extending from the suspension portion to a direction away from the vibration portion. The housing includes a holder supporting the sounding unit, and a lower cover and an upper cover that are respectively arranged on two opposite sides of the sounding unit along a vibrating direction of the diaphragm. The holder includes a holder body spaced from and arranged opposite to the sounding unit, a holder extension portion bending and extending from a periphery of the holder body to the sounding unit, and a holder fixing portion bending and extending from the holder extension portion to a direction away from the holder body. One side of the sounding unit provided with the diaphragm is supported by and fixed to the holder fixing portion. An orthographic projection of the vibration portion along the vibrating direction to the holder completely falls into the holder body. The suspension portion is of an arc-shaped structure formed by recessing toward a direction away from the holder body. The lower cover includes a lower cover plate arranged on one side of the sounding unit away from the diaphragm, and a lower cover sidewall bending and extending from a periphery of the lower cover plate. The lower cover sidewall is provided with a sound outlet running therethrough. One side of the sounding unit close to the sound outlet abuts against the lower cover sidewall. The lower cover sidewall is spaced from the holder fixing portion. One side of the holder close to the sound outlet is provided with an avoiding gap for avoiding the sound outlet. The upper cover has one end fixed to the lower cover and the other end fixed to the holder and spacing the upper cover from the holder fixing portion. The sounding unit, the holder and the lower cover sidewall define a front sound cavity together, the diaphragm is received in the front sound cavity. The sound outlet communicates the front sound cavity with the outside. The sounding unit and the lower cover define a rear sound cavity together, and the lower cover sidewall. The holder fixing portion, the holder extension portion and the upper cover together define an auxiliary rear sound cavity communicated with the rear sound cavity.

As an improvement, an orthographic projection of the holder extension portion along the vibrating direction of the diaphragm to the sounding unit completely falls into the suspension portion.

As an improvement, the upper cover has one end fixed to the lower cover sidewall and the other end fixed to the holder extension portion.

As an improvement, the upper cover includes an upper cover body spaced from and opposite to the holder fixing portion and connected to the lower cover sidewall and the holder extension portion. A groove portion recessed from the upper cover body to a direction away from the holder fixing portion.

As an improvement, one side of the groove portion away from the lower cover plate is flush with one side of the holder body away from the lower cover plate.

As an improvement, one side of the upper cover away from the lower cover plate and one end of the lower cover sidewall away from the lower cover plate are both flush with one side of the holder body away from the lower cover plate.

As an improvement, the holder is made of a metal material.

As an improvement, the upper cover and the holder fixing portion are at a distance of 0.8 mm.

As an improvement, the lower cover plate is in a shape of a rectangle, four lower cover sidewalls are provided and are sequentially connected end to end, a sound output portion is formed on one side of one of the lower cover sidewalls away from the lower cover plate. The sound output portion is provided with the sound outlet running therethrough. One side of the sounding unit close to the sound outlet is fixed to the sound output portion, and one side of the holder body close to the sound outlet is fixed to the sound output portion.

As an improvement, one side of the holder body close to the sound outlet is embedded into the sound output portion to form a fixed structure.

Compared with the related art, in the speaker box according to the present disclosure, the holder includes a holder body, a holder extension portion bending and extending from the holder body to the sounding unit and a holder fixing portion bending and extending from the holder extension portion to a direction away from the holder body. One side of the sounding unit provided with the diaphragm is supported by and fixed to the holder fixing portion. An orthographic projection of the vibration portion along the vibrating direction to the holder completely falls into the holder body. The suspension portion of the diaphragm is of an arc-shaped structure formed by recessing toward a direction away from the holder body. In the above structure, the front sound cavity is not required to avoid and profile the suspension portion, and the recessed suspension portion does not occupy the cavity volume of the front sound cavity, so that the front sound cavity has a large cavity volume, which effectively improves high-frequency acoustic performance of the speaker box. In addition, the upper cover has one end fixed to the lower cover and the other end fixed to the holder, and the upper cover is spaced from the holder fixing portion, so that the lower cover sidewall, the holder fixing portion, the holder extension portion and the upper cover define an auxiliary rear sound cavity communicated with the rear sound cavity. The structure enables the auxiliary rear sound cavity to be equivalent to an additional cavity volume in the upper cover in the related art. That is, the rear sound cavity is communicated with the auxiliary rear sound cavity to form a larger sound cavity. Therefore, the volume of the sound cavity configured to improve low-frequency acoustic performance is effectively increased, thereby improving the low-frequency acoustic performance of the speaker box.

BRIEF DESCRIPTION OF DRAWINGS

In order to more clearly illustrate the technical solutions in embodiments of the present disclosure, the accompanying drawings used in the description of the embodiments will be briefly introduced below. It is apparent that, the accompanying drawings in the following description are only some embodiments of the present disclosure, and other drawings can be obtained by those of ordinary skill in the art from the structures shown in the provided drawings without creative efforts.

DESCRIPTION OF EMBODIMENTS

The technical solutions in embodiments of the present disclosure will be described clearly and completely below with reference to the accompanying drawings in the embodiments of the present disclosure. It is appreciated that, the described embodiments are merely some of rather than all of the embodiments of the present disclosure. All other embodiments acquired by those skilled in the art without creative efforts based on the embodiments of the present disclosure shall fall within the protection scope of the present disclosure.

Figure 1:
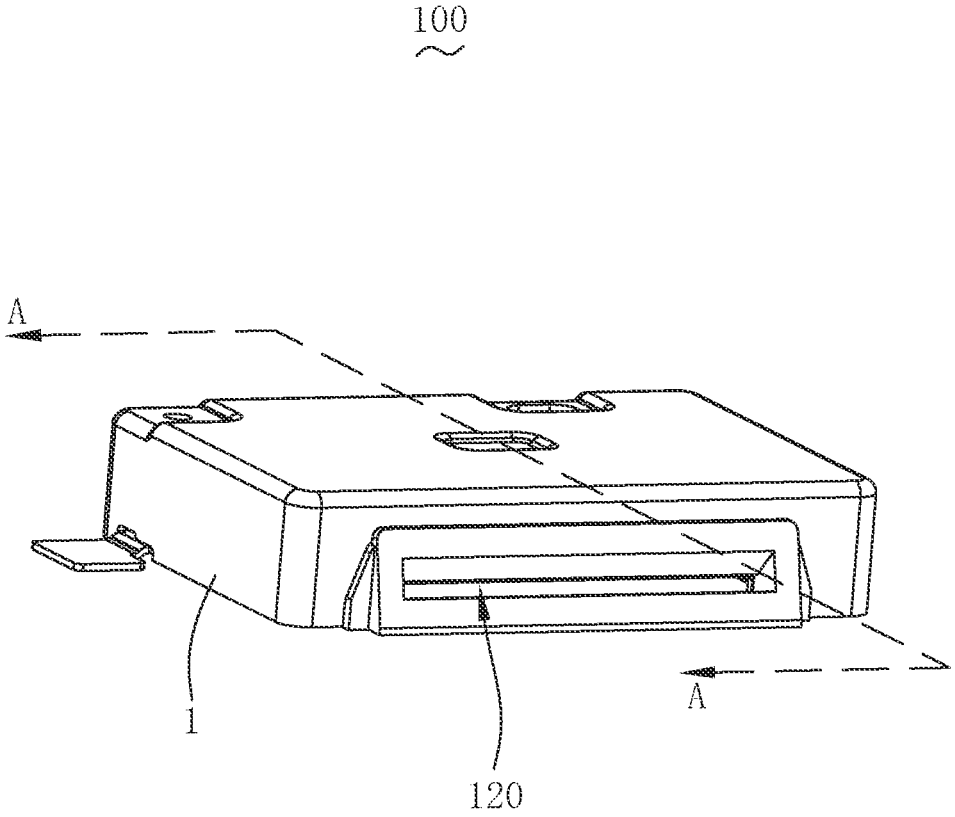
FIG. 1 is a schematic diagram of a perspective structure of a speaker box according to the present disclosure.
Figure 2:
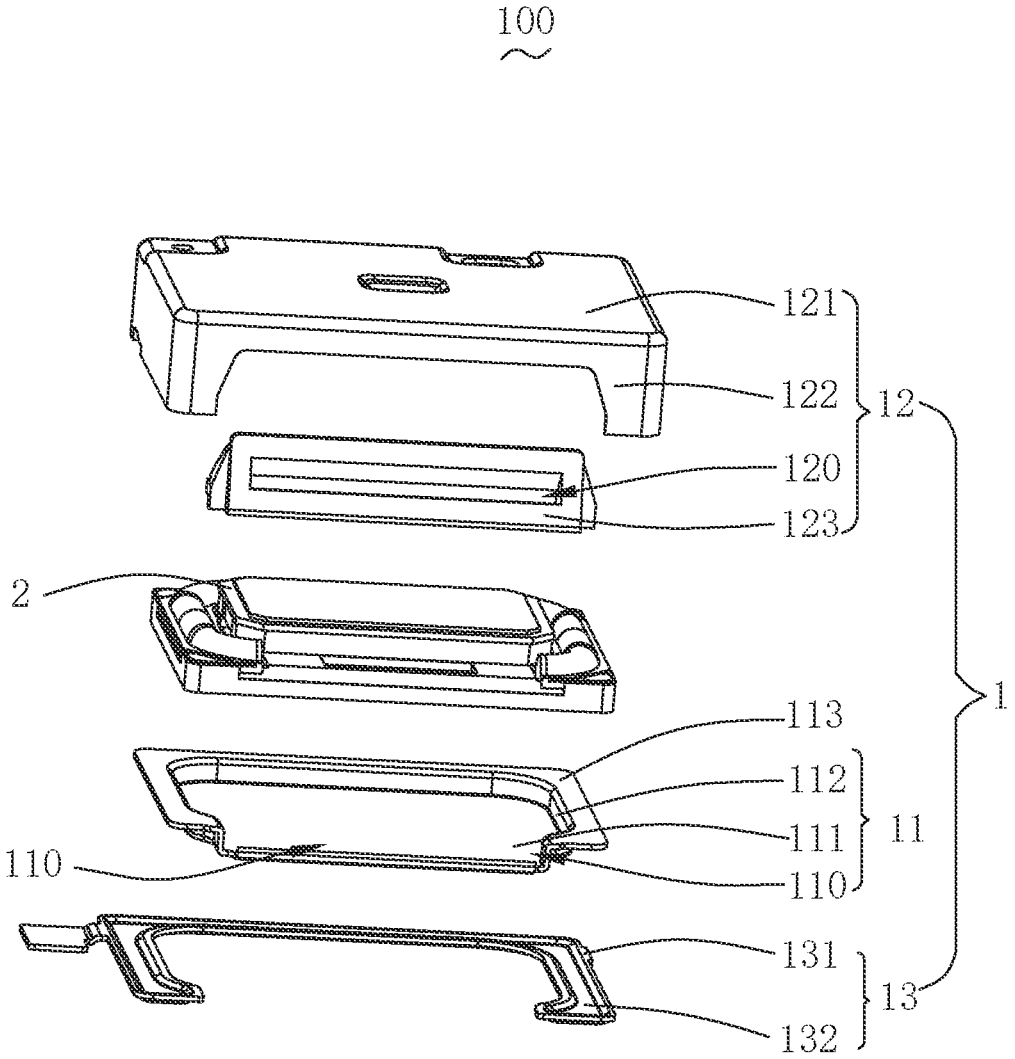
FIG. 2 is a schematic exploded view of a partial perspective structure of the speaker box according to the present disclosure.
Figure 3:
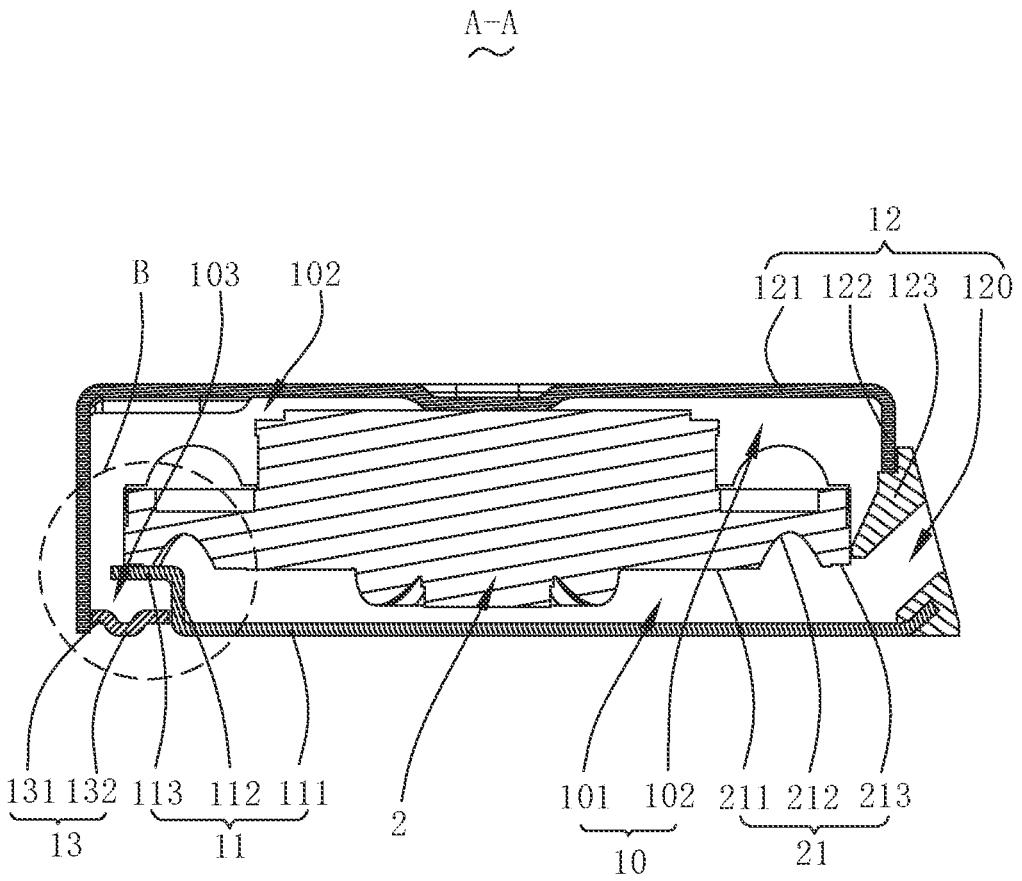
FIG. 3 is a sectional view taken along a line A-A in FIG. 1.
Figure 4:
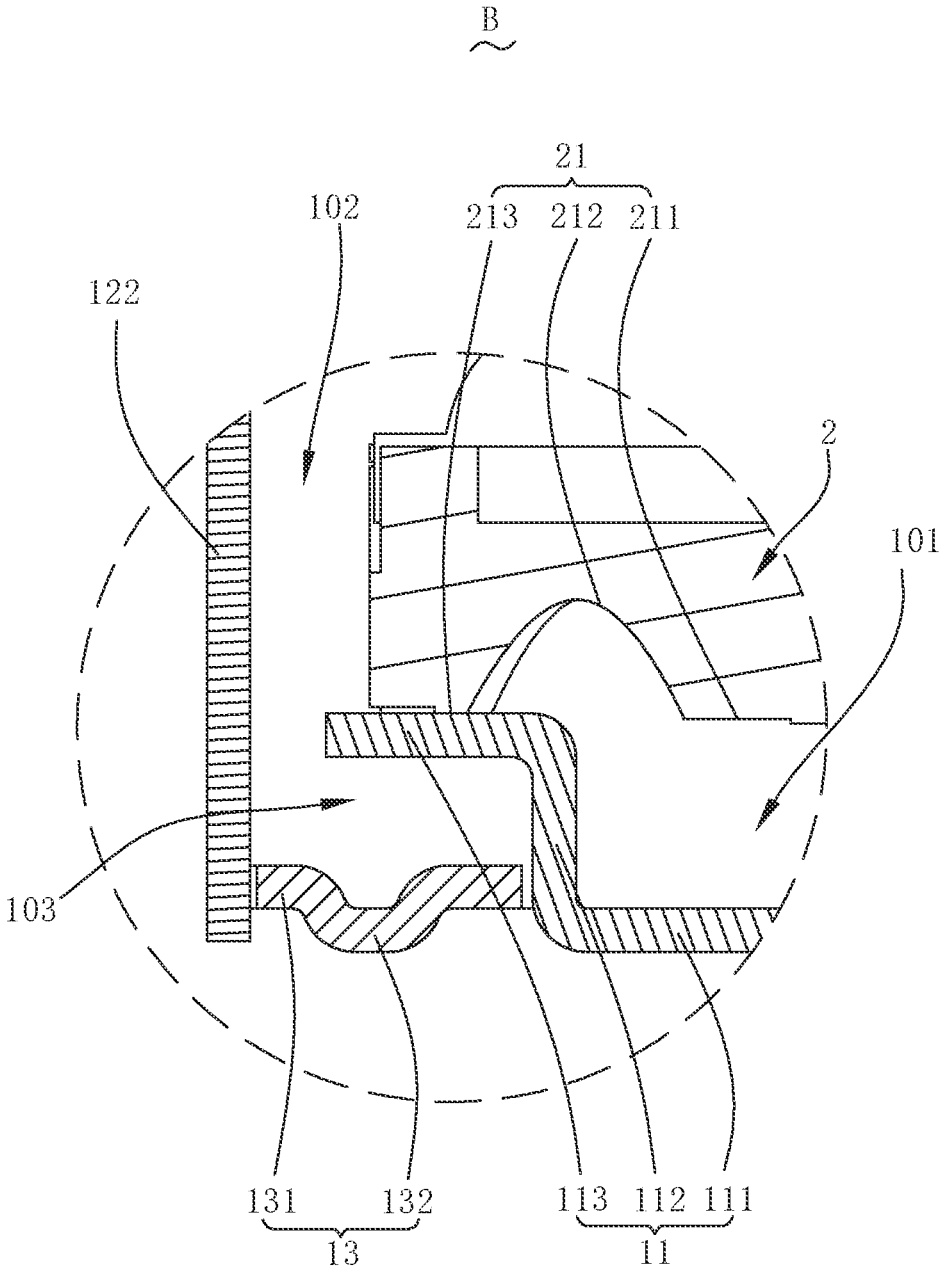
FIG. 4 is an enlarged view of a part B in FIG. 3.

Referring to FIG. 1 to FIG. 4 together, the present disclosure provides a speaker box 100.

The speaker box 100 includes a housing 1 having a receiving space 10 and a sounding unit 2 received in the receiving space 10.

The sounding unit 2 includes a diaphragm 21 configured to vibrate and sound. The diaphragm 21 includes a vibration portion 211, a suspension portion 212 bending and extending from a periphery of the vibration portion 211 to a direction away from the vibration portion 211, and a diaphragm fixing portion 213 bending and extending from the suspension portion 212 to a direction away from the vibration portion 211.

The housing 1 includes a holder 11 supporting the sounding unit 2 and a lower cover 12 and an upper cover 13 that are respectively arranged on two opposite sides of the sounding unit 2 along a vibrating direction of the diaphragm 21. The holder 11, the lower cover 12 and the upper cover 13 define the receiving space 10 together.

The holder 11 includes a holder body 111 spaced from and arranged opposite to the sounding unit 2, a holder extension portion 112 bending and extending from a periphery of the holder body 111 to the sounding unit 2, and a holder fixing portion 113 bending and extending from the holder extension portion 112 to a direction away from the holder body 111.

One side of the sounding unit 2 provided with the diaphragm 21 is supported by and fixed to the holder fixing portion 113. The diaphragm fixing portion 213 is supported by and fixed to the holder fixing portion 113. In this embodiment, the diaphragm fixing portion 213 is fixed to the holder fixing portion 113 by glue.

The lower cover 12 includes a lower cover plate 121 arranged on one side of the sounding unit 2 away from the diaphragm 21, and a lower cover sidewall 122 bending and extending from a periphery of the lower cover plate 121.

The lower cover plate 121 and the lower cover sidewall 122 may be two separate parts or integrally manufactured. In this embodiment, the lower cover plate 121 and the lower cover sidewall 122 are integrally formed.

The sounding unit 2, the holder 11 and the lower cover sidewall 122 define a front sound cavity 101 together. The diaphragm 21 is received in the front sound cavity 101. The front sound cavity 101 improves high-frequency acoustic performance of the speaker box 100.

The lower cover sidewall 122 is provided with a sound outlet 120 running therethrough. The sound outlet 120 communicates the front sound cavity 101 with the outside. The structure forms a lateral sounding structure of the speaker box 100, which is intended to improve air communication between the lateral sounding structure and the outside, so as to improve the audio quality of the speaker box 100.

One side of the sounding unit 2 close to the sound outlet 120 abuts against the lower cover sidewall 122. The lower cover sidewall 122 is spaced from the holder fixing portion 113. One side of the holder 11 close to the sound outlet 120 is provided with an avoiding gap 110 avoiding the sound outlet 120. The result enables the sounding unit 2 and the holder 11 form a fixed seal. Thus, the sounding unit 2 and the lower cover 12 define a rear sound cavity 102 together. The rear sound cavity 102 improves low-frequency acoustic performance of the speaker box 100.

In order to facilitate manufacturing and assembly, the lower cover plate 121 is in a shape of a rectangle in this embodiment. Four lower cover sidewalls 122 are provided and are sequentially connected end to end. A sound output portion 123 is formed on one side of one of the lower cover sidewalls 122 away from the lower cover 12 plate. The sound output portion 123 is provided with the sound outlet 120 running therethrough. One side of the sounding unit 2 close to the sound outlet 120 is fixed to the sound output portion 123. One side of the holder body 111 close to the sound outlet 120 is fixed to the sound output portion 123. The structure enables the housing 1 where the sound outlet 120 is located to be separated from the lower cover sidewall 122. The separated member is the sound output portion 123. Thus, the manufacturing of the lower cover 12 is simple, and the sound output portion 123 is also easy to manufacture and assemble, thereby improving the manufacturing efficiency of the speaker box 100.

More optionally, one side of the holder body 111 close to the sound outlet 120 is embedded into the sound output portion 123 to form a fixed structure. The structure helps to improve the firmness of the housing 1, thereby improving the reliability of the speaker box 100.

The upper cover 13 has one end fixed to the lower cover 12 and the other end fixed to the holder 11. The upper cover 13 has one end fixed to the lower cover sidewall 122 and the other end fixed to the holder extension portion 112. That is, the upper cover 13 and the holder 11 form a fixed seal. The structure enables the upper cover 13 to be arranged on an outer side of the holder extension portion 112.

The upper cover 13 is spaced from the holder fixing portion 113. The structure enables the lower cover sidewall 122, the holder fixing portion 113, the holder extension portion 112 and the upper cover 13 to define an auxiliary rear sound cavity 103 communicated with the rear sound cavity 102. The auxiliary rear sound cavity 103 is located on the outer side of the holder extension portion 112. The structure enables the auxiliary rear sound cavity 103 to be equivalent to an additional cavity volume in the upper cover in the related art. That is, the rear sound cavity 102 is communicated with the auxiliary rear sound cavity to form a larger sound cavity. Therefore, the volume of the sound cavity configured to improve low-frequency acoustic performance is effectively increased, thereby improving the low-frequency acoustic performance of the speaker box 100.

In an embodiment, an orthographic projection of the vibration portion 211 along the vibrating direction to the holder 11 completely falls into the holder body 111. The suspension portion 212 is of an arc-shaped structure formed by recessing toward a direction away from the holder body 111. The structure enables the front sound cavity 101 not to be required to avoid and profile the suspension portion 212, and the recessed suspension portion 212 does not occupy the cavity volume of the front sound cavity 101, so that the front sound cavity 101 has a large cavity volume, which effectively improves high-frequency acoustic performance of the speaker box 100.

The suspension portion 212 being of an arc-shaped structure formed by recessing not only increases the cavity volume of the front sound cavity 101, but also increases the cavity volume of the auxiliary rear sound cavity 103. In this embodiment, an orthographic projection of the holder extension portion 112 along a vibrating direction of the diaphragm 21 to the sounding unit 2 completely falls into the suspension portion 212. The structure enables a cavity space (i.e., part of the rear sound cavity 102) formed by the upper cover 13 and the holder fixing portion 113 to extend to a position directly in front of the suspension portion 212. That is, features of a reverse suspension are utilized in such structure. The holder extension portion 112 is retracted toward a central position of the sounding unit 2, and an available space of the rear sound cavity 102 is released outwards to a maximum extent without affecting vibration space of the sounding unit 2, so as to increase the volume of the rear sound cavity 102, thereby improving the low-frequency acoustic performance of the speaker box 100.

In an embodiment, the holder 11 is made of a metal material. On the premise of ensuring the structural strength of the housing 1, the housing 1 can be designed thinner than a conventional plastic holder structure, and also be assembled with the sounding unit 2 effectively, so as to greatly increase the cavity volume in the housing 1 and effectively increasing the volume of the rear sound cavity 102 defined by the sounding unit 2 and the housing 1, thereby improving the acoustic performance of the speaker box 100, especially the low-frequency acoustic performance. In this embodiment, the upper cover 13 and the holder fixing portion 113 are at a distance of 0.8 mm along the vibrating direction of the diaphragm 21. Upon comparison between the structure and the conventional plastic holder structure, the support wall of the conventional plastic holder structure configured for positioning and configured to support the sounding unit 2 has a thickness of about 1 mm. After the use of the holder 11 made of a metal material, a width space of 0.8 mm may be saved to improve the volume of the rear sound cavity 102, so as to enable the speaker box 100 to have better low-frequency acoustic performance.

In this embodiment, the upper cover 13 includes an upper cover body 131 spaced from and opposite to the holder fixing portion 113 and connected to the lower cover sidewall 122 and the holder extension portion 112, and a groove portion 132 recessed from the upper cover body 131 to a direction away from the holder fixing portion 113. The structure, through the groove portion 132 formed by recessing, further increases the volume of the auxiliary rear sound cavity 103 while ensuring a constant height of the speaker box 100, so as to enable the speaker box 100 to have better low-frequency acoustic performance.

In this embodiment, one side of the groove portion 132 away from the lower cover plate 121 is flush with one side of the holder body 111 away from the lower cover plate 121. The structure enables an overall appearance of the housing 1 to be consistent while increasing the volume of the auxiliary rear sound cavity 103, so as to facilitate the assembly of the speaker box 100 and improve the reliability.

In this embodiment, one side of the upper cover 13 away from the lower cover plate 121 is flush with one end of the lower cover sidewall 122 away from the lower cover plate 121, and the side and the end are both flush with one side of the holder body 111 away from the lower cover plate 121. The arrangement enables the speaker box 100 to be simple to assemble and good-looking, and also enables the overall appearance of the housing 1 to be consistent, so as to facilitate the assembly of the speaker box 100 and improve the reliability.

Compared with the related art, in the speaker box according to the present disclosure, the holder includes a holder body, a holder extension portion bending and extending from the holder body to the sounding unit, and a holder fixing portion bending and extending from the holder extension portion to a direction away from the holder body. One side of the sounding unit provided with the diaphragm is supported by and fixed to the holder fixing portion. An orthographic projection of the vibration portion along the vibrating direction to the holder completely falls into the holder body. The suspension portion of the diaphragm is of an arc-shaped structure formed by recessing toward a direction away from the holder body. In the above structure, the front sound cavity is not required to avoid and profile the suspension portion, and the recessed suspension portion does not occupy the cavity volume of the front sound cavity, so that the front sound cavity has a large cavity volume, which effectively improves high-frequency acoustic performance of the speaker box. In addition, the upper cover has one end fixed to the lower cover and the other end fixed to the holder, and the upper cover is spaced from the holder fixing portion, so that the lower cover sidewall, the holder fixing portion, the holder extension portion and the upper cover define an auxiliary rear sound cavity communicated with the rear sound cavity. The structure enables the auxiliary rear sound cavity to be equivalent to an additional cavity volume in the upper cover in the related art. That is, the rear sound cavity is communicated with the auxiliary rear sound cavity to form a larger sound cavity. Therefore, the volume of the sound cavity configured to improve low-frequency acoustic performance is effectively increased, thereby improving the low-frequency acoustic performance of the speaker box.

The above are only embodiments of the present disclosure. It should be pointed out that those of ordinary skill in the art may also make improvements without departing from the ideas of the present disclosure, all of which fall within the protection scope of the present disclosure.

What is claimed is:

1. A speaker box, comprising a housing having a receiving space and a sounding unit received in the receiving space, the sounding unit comprising a diaphragm configured to vibrate and sound, the diaphragm comprising a vibration portion, a suspension portion bending and extending from a periphery of the vibration portion to a direction away from the vibration portion, and a diaphragm fixing portion bending and extending from the suspension portion to a direction away from the vibration portion, wherein the housing comprises a holder supporting the sounding unit, and a lower cover and an upper cover that are respectively arranged on two opposite sides of the sounding unit along a vibrating direction of the diaphragm;

the holder comprises a holder body spaced from and arranged opposite to the sounding unit, a holder extension portion bending and extending from a periphery of the holder body to the sounding unit, and a holder fixing portion bending and extending from the holder extension portion to a direction away from the holder body, and one side of the sounding unit provided with the diaphragm is supported by and fixed to the holder fixing portion; an orthographic projection of the vibration portion along the vibrating direction to the holder completely falls into the holder body, and the suspension portion is of an arc-shaped structure formed by recessing toward a direction away from the holder body;

the lower cover comprises a lower cover plate arranged on one side of the sounding unit away from the diaphragm, and a lower cover sidewall bending and extending from a periphery of the lower cover plate, the lower cover sidewall is provided with a sound outlet running therethrough, one side of the sounding unit close to the sound outlet abuts against the lower cover sidewall, the lower cover sidewall is spaced from the holder fixing portion, and one side of the holder close to the sound outlet is provided with an avoiding gap for avoiding the sound outlet;

the upper cover has one end fixed to the lower cover and the other end fixed to the holder and spacing the upper cover from the holder fixing portion; and the sounding unit, the holder and the lower cover sidewall together define a front sound cavity, the diaphragm is received in the front sound cavity, and the sound outlet communicates the front sound cavity with the outside; the sounding unit and the lower cover together define a rear sound cavity, and the lower cover sidewall, the holder fixing portion, the holder extension portion and the upper cover together define an auxiliary rear sound cavity communicated with the rear sound cavity.

2. The speaker box as described in claim 1, wherein an orthographic projection of the holder extension portion along the vibrating direction of the diaphragm to the sounding unit completely falls into the suspension portion.

3. The speaker box as described in claim 1, wherein the upper cover has one end fixed to the lower cover sidewall and the other end fixed to the holder extension portion.

4. The speaker box as described in claim 3, wherein the upper cover comprises an upper cover body spaced from and opposite to the holder fixing portion and connected to the lower cover sidewall and the holder extension portion, and a groove portion recessed from the upper cover body to a direction away from the holder fixing portion.

5. The speaker box as described in claim 4, wherein one side of the groove portion away from the lower cover plate is flush with one side of the holder body away from the lower cover plate.

6. The speaker box as described in claim 3, wherein one side of the upper cover away from the lower cover plate and one end of the lower cover sidewall away from the lower cover plate are both flush with one side of the holder body away from the lower cover plate.

7. The speaker box as described in claim 1, wherein the holder is made of a metal material.

8. The speaker box as described in claim 1, wherein the upper cover and the holder fixing portion are at a distance of 0.8 mm.

9. The speaker box as described in claim 1, wherein the lower cover plate is in a shape of a rectangle, four lower cover sidewalls are provided and are sequentially connected end to end, a sound output portion is formed on one side of one of the four lower cover sidewalls away from the lower cover plate, and the sound output portion is provided with the sound outlet running therethrough; one side of the sounding unit close to the sound outlet is fixed to the sound output portion; and one side of the holder body close to the sound outlet is fixed to the sound output portion.

10. The speaker box as described in claim 9, wherein one side of the holder body close to the sound outlet is embedded into the sound output portion to form a fixed structure.

* * * * *